US008550173B2

(12) United States Patent
Zevenbergen et al.

(10) Patent No.: US 8,550,173 B2
(45) Date of Patent: Oct. 8, 2013

(54) LOCKING SAFETY JOINT FOR USE IN A SUBTERRANEAN WELL

(71) Applicant: Halliburton Energy Services, Inc., Houston, TX (US)

(72) Inventors: Reid E. Zevenbergen, Carrollton, TX (US); Paul D. Ringgenberg, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/772,044

(22) Filed: Feb. 20, 2013

(65) Prior Publication Data

US 2013/0233567 A1 Sep. 12, 2013

(30) Foreign Application Priority Data

Mar. 6, 2012 (WO) ..... PCT/US12/27803

(51) Int. Cl.
*E21B 17/06* (2006.01)

(52) U.S. Cl.
USPC ..... 166/377; 166/242.6

(58) Field of Classification Search
USPC ..... 166/377, 380, 242.6, 242.7; 175/320; 403/348, 349; 285/922
See application file for complete search history.

(56) References Cited

U.S. PATENT DOCUMENTS

| | | | | |
|---|---|---|---|---|
| 2,202,260 | A * | 5/1940 | Osmun | 285/81 |
| 2,802,534 | A | 8/1957 | Conrad et al. | |
| 2,919,900 | A * | 1/1960 | Segelhorst | 285/86 |
| 3,524,501 | A | 8/1970 | Armstrong et al. | |
| 4,484,633 | A | 11/1984 | Brandell | |
| 4,858,690 | A | 8/1989 | Rebardi et al. | |
| 4,971,365 | A | 11/1990 | Schultz | |
| 7,204,305 | B2 | 4/2007 | Ricalton et al. | |
| 7,380,596 | B2 | 6/2008 | De Clute-Melancon | |
| 7,431,094 | B2 | 10/2008 | De Clute-Melancon | |
| 2006/0131011 | A1 | 6/2006 | Lynde et al. | |
| 2009/0095490 | A1 | 4/2009 | Moriarty et al. | |
| 2011/0308784 | A1 | 12/2011 | Ollerenshaw et al. | |

FOREIGN PATENT DOCUMENTS

EP 0928361 B1 2/2004

OTHER PUBLICATIONS

Halliburton; "Body Lock Ring", Mechanical Downhole: Technology Transfer, dated Oct. 10, 2001, 4 pages.
International Search Report with Written Opinion issued Nov. 5, 2012 for PCT Patent Application No. PCT/US12/027799, 9 pages.
International Search Report with Written Opinion issued Nov. 14, 2012 for PCT Patent Application No. PCT/US12/027797, 9 pages.

(Continued)

*Primary Examiner* — Daniel P Stephenson
(74) *Attorney, Agent, or Firm* — Smith IP Services, P.C.

(57) ABSTRACT

A safety joint for use in a subterranean well can include separable portions which, when separated, disconnect sections of a tubular string. Elongation of the safety joint can be permitted while longitudinal compression of the safety joint is prevented. A method of activating a safety joint in a subterranean well can include providing the safety joint with portions having end connectors which interconnect the safety joint between sections of a tubular string, permitting elongation of the safety joint, thereby facilitating disconnection of the tubular string sections, and then preventing longitudinal compression of the safety joint. Another safety joint can include separable portions, and a locking device which permits relative displacement between a generally tubular mandrel and a component of the safety joint in one direction, and prevents relative displacement between the mandrel and the component in an opposite direction.

12 Claims, 7 Drawing Sheets

(56) References Cited

OTHER PUBLICATIONS

International Search Report with Written Opinion issued Nov. 29, 2012 for PCT Patent Application No. PCT/US12/027803, 9 pages.
Specification and Drawings for U.S. Appl. No. 13/772,023, filed Feb. 20, 2013, 33 pages.
Specification and Drawings for U.S. Appl. No. 13/771,990, filed Feb. 20, 2013, 29 pages.
Halliburton; "Cased Hole", company article pp. 5-7 to 5-38, retrieved Dec. 20, 2011, 32 pages.
Halliburton; "RTTS Safety Joint", Company article H08346, dated Apr. 2011, 2 pages.
Halliburton; "Champ IV Non-Rotational Retrievable Packer", Completion Tools article, retrieved Dec. 17, 2011, 1 page.
Halliburton; "Below Packer Hydraulic Safety Joint", company article, retrieved Dec. 17, 2011, 1 page.
Halliburton; "Anchor Pipe Safety Joint", company article, retrieved Oct. 27, 2011, 10 pages.
Search Report issued Nov. 29, 2012 for International Application PCT/US12/27803, 5 pages.
Written Opinion issued Nov. 29, 2012 for International Application PCT/US12/27803, 4 pages.

* cited by examiner

LOCKING SAFETY JOINT FOR USE IN A SUBTERRANEAN WELL

CROSS-REFERENCE TO RELATED APPLICATION

This application claims the benefit under 35 USC §119 of the filing date of International Application Serial No. PCT/US12/27803 filed 6 Mar. 2012. The entire disclosure of this prior application is incorporated herein by this reference.

BACKGROUND

This disclosure relates generally to equipment utilized and operations performed in conjunction with a subterranean well and, in one example described below, more particularly provides for locking a safety joint in an extended configuration.

A safety joint is typically interconnected in a tubular string to allow the tubular string to be parted at the safety joint, for example, in the event that a packer or other equipment becomes stuck in a wellbore. After the safety joint separates, the tubular string above the safety joint can be readily retrieved from the wellbore.

It will be appreciated that improvements are continually needed in the art of constructing safety joints.

SUMMARY

In this disclosure, systems and methods are provided which bring improvements to the arts of constructing and operating safety joints. One example is described below in which a packer connected to the safety joint is prevented from setting after the safety joint is activated. Another example is described below in which a safety joint is prevented from longitudinally compressing after it has been elongated.

A safety joint for use in a subterranean well is described below. In one example, the safety joint can include separable portions which, when separated, disconnect sections of a tubular string. Elongation of the safety joint is permitted while longitudinal compression of the safety joint is prevented.

A method of activating a safety joint in a subterranean well is also provided to the art. In one example described below, the method can include: providing the safety joint with portions having end connectors which interconnect the safety joint between sections of a tubular string; permitting elongation of the safety joint, thereby facilitating disconnection of the tubular string sections; and then preventing longitudinal compression of the safety joint.

Another safety joint can include separable portions, and a locking device which permits relative displacement between a generally tubular mandrel and a component of the safety joint in one direction, and prevents relative displacement between the mandrel and the component in an opposite direction.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
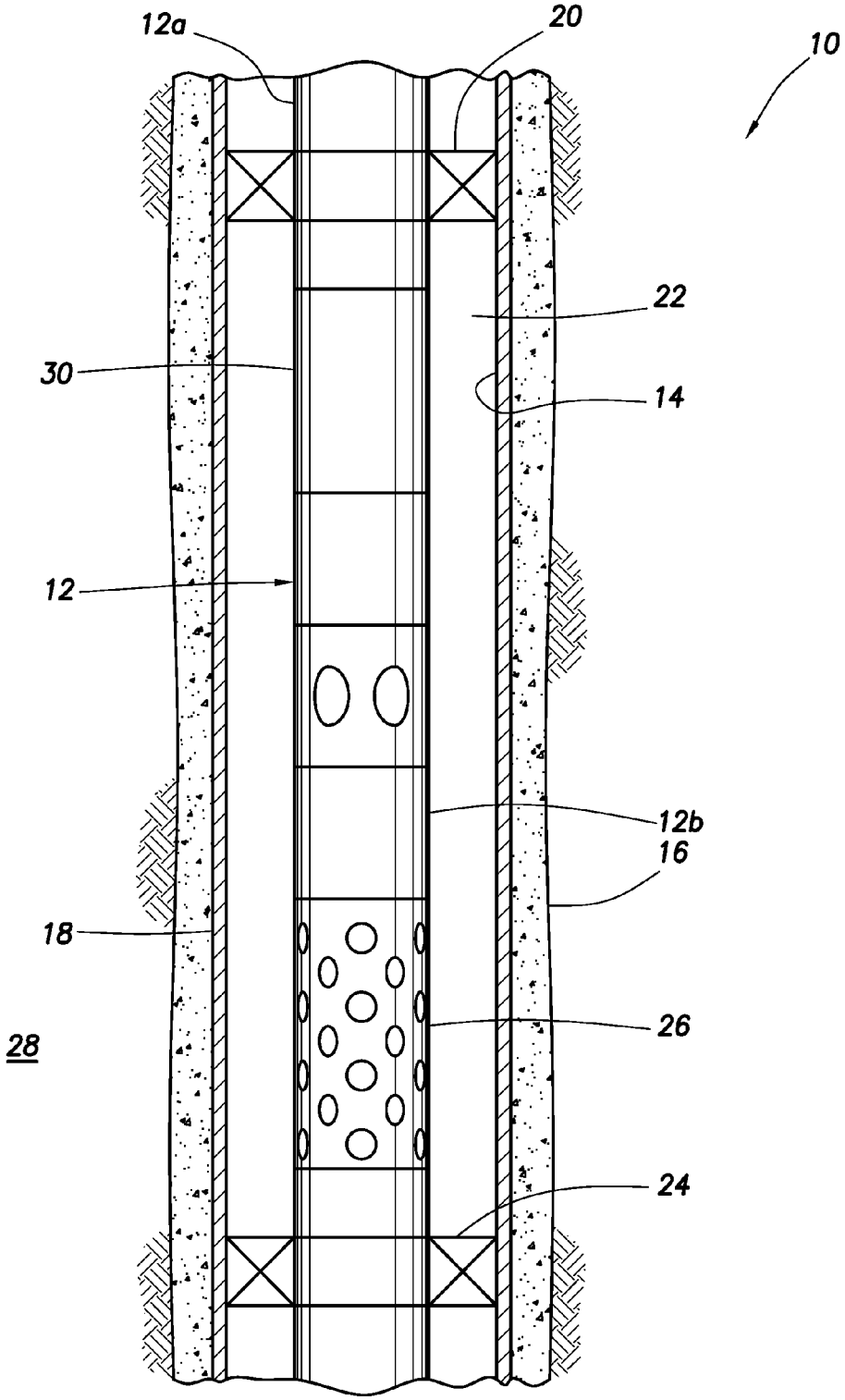
FIG. 1 is a representative partially cross-sectional view of a well system and associated method which can embody principles of this disclosure.

Representatively illustrated in FIG. 1 is a well system 10 and associated method which can embody principles of this disclosure. However, it should be clearly understood that the system 10 and method are merely one example of how the principles of this disclosure can be applied in practice, and so the scope of this disclosure is not limited at all to the details of the system and method as depicted in the drawings and described below.

In the FIG. 1 example, a tubular string 12 is installed in a wellbore 14 lined with cement 16 and casing 18. A packer 20 is set to thereby seal off an annulus 22 formed radially between the tubular string 12 and the wellbore 14. Another packer 24 (or a bridge plug, etc.) may be used if desired to seal off the wellbore 14, so that the annulus 22 is isolated between the packers 20, 24.

The tubular string 12 could be used for any purpose (such as, drill stem testing, completion operations, stimulation operations, etc.). In the depicted example, one or more perforating guns 26 are interconnected in the tubular string 12 for perforating the casing 18 and cement 16, so that fluid can be produced from, or injected into, an earth formation 28 penetrated by the wellbore 14. The formation 28 can then be tested by performing pressure buildup and drawdown tests, in a manner well known to those skilled in the art.

A safety joint 30 is interconnected in the tubular string 12 below (as viewed in FIG. 1) the packer 20. In the event that the packer 24, the perforating gun 26 or another item of equipment below the safety joint 30 becomes stuck or otherwise cannot be readily retrieved from the wellbore 14, the safety joint can be activated to disconnect an upper section 12*a* of the tubular string 12 from a lower section 12*b* of the tubular string, so that the upper section can be retrieved. A separate "fishing" trip can then be used to retrieve the lower section 12*b* of the tubular string 12.

Note that it is not necessary for all of the wellbore 14 to be lined with cement 16 or casing 18, the tubular string 12 could include additional, fewer or different elements from those depicted in FIG. 1, the wellbore can be horizontal or inclined, etc. Thus, it will be appreciated that the scope of this disclosure is not limited to the example configuration representatively illustrated in FIG. 1.

Unfortunately, in certain circumstances (such as, when operating from a floating rig, etc.), it can be possible to again set a packer after a safety joint has been activated and elongated, but prior to disconnection of the tubular string sections 12*a,b* from each other. This due to the fact that many, if not most, retrievable packers are set by lowering a tubular string in which the packer is connected (typically after performing some other action, such as, rotating the tubular string to operate a J-slot mechanism, lowering and raising the tubular string a predetermined number of times, applying a predetermined pressure to the packer, etc.), and such lowering of the tubular string can occur inadvertently (e.g., due to wave motion heave on a floating rig, setting surface slips when disconnecting pipe joints on a floating or fixed rig, etc.).

If this happens (re-setting of the packer after activation of the safety joint but prior to disconnection of the tubular string sections), it can be very difficult, time-consuming and, therefore, very expensive to use contingency measures (e.g., washing-over the packer, using chemical or explosive means to sever a mandrel of the packer, etc.) to retrieve the packer. One reason for this is that to unset many, if not most, retrievable packers, the packer mandrel is raised a predetermined distance, and this typically cannot be done if the safety joint has already been activated and elongated, but the tubular string has not yet parted at the safety joint.

However, in the improved system 10 and method of FIG. 1, the safety joint 30 includes a feature which prevents the packer 20 from setting after the safety joint has been elongated. In this manner, the upper section 12*a* of the tubular string 12 can be conveniently retrieved from the wellbore 14, without the possibility of the packer 20 inadvertently setting after the safety joint 30 has been elongated. In an example described more fully below, setting of the packer 20 can be prevented, whether or not the tubular string 12 has parted at the safety joint 30.

Figure 2:
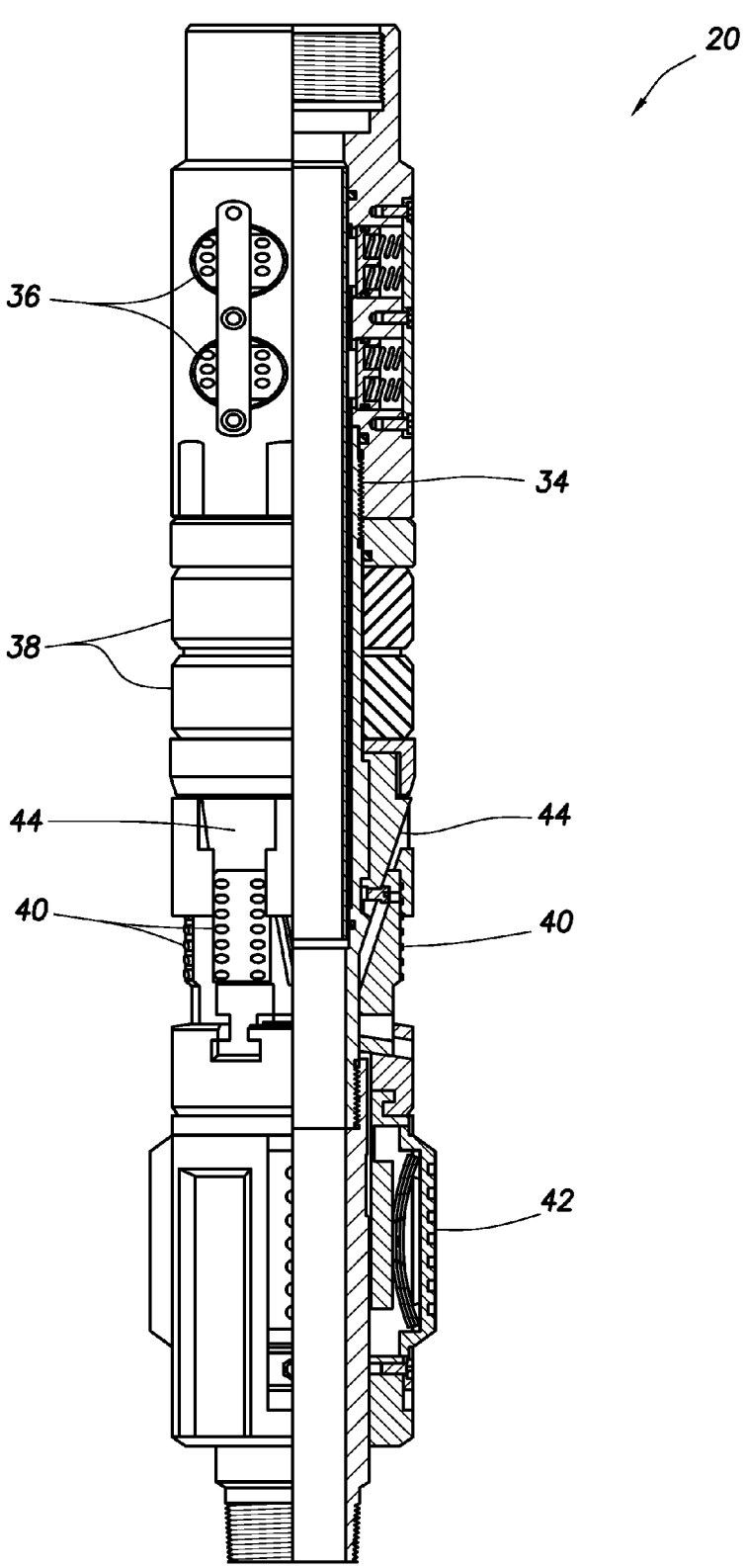
FIG. 2 is a partially cross-sectional view of a prior art packer.

Referring additionally now to FIG. 2, the packer 20 is representatively illustrated, apart from the remainder of the system 10. The packer 20 may be similar in many respects to a prior art RTTS™ packer marketed by Halliburton Energy Services, Inc. of Houston, Tex. USA, and well known to those skilled in the art.

The packer 20 is representative of a retrievable packer, operation of which can benefit from the principles of this disclosure. However, other types of packers may be used, in keeping with the scope of this disclosure. Examples of other packers which may be used include the CHAMP IV™ and CHAMP V™ packers, also marketed by Halliburton Energy Services, Inc.

The packer 20 includes a generally tubular mandrel 34, a set of hydraulically actuated slips 36, a set of seal elements 38, a set of mechanically actuated slips 40 and a drag block 42. A J-slot mechanism (not visible in FIG. 2) controls whether the mandrel 34 can be lowered (as viewed in FIG. 2) relative to the seal elements 38, slips 40 and drag block 42. The drag block 42 is biased into contact with an inner wall of the casing 18 (or the formation 28 in an uncased wellbore) and thereby provides a frictional force, so that the mandrel 34 will displace downward relative to the seal elements 38, slips 40 and drag block when the J-slot mechanism is operated to its "set" position (allowing downward displacement of the mandrel relative to the drag block 42, etc.).

To set the packer 20, the packer is positioned lower in the wellbore 14 than its intended setting location, the packer is then raised and rotated to select the J-slot mechanism "set" position, and the tubular string 12 is then lowered to set the packer. The frictional force provided by the drag block 42 urges the slips 40 upward along ramps 44, so that the slips displace radially outward and obtain an initial "bite" into the casing 18 (or formation 28 if the wellbore 14 is uncased). Further lowering of the tubular string 12 and mandrel 34 compresses the seal elements 38, thereby radially outwardly extending the seal elements and sealing off the annulus 22.

Note that, if the mandrel 34 cannot displace downward relative to the drag block 42, the slips 40 will not displace radially outward, and the packer 20 will not set. Therefore, by preventing downward displacement of the mandrel 34 (and the tubular string section 12*a* to which it is connected), setting of the packer 20 can be prevented.

After being set, the packer 20 can be unset by raising the mandrel 34, thereby decompressing the seal elements 38 and allowing the slips 40 to retract inward.

Figure 3:
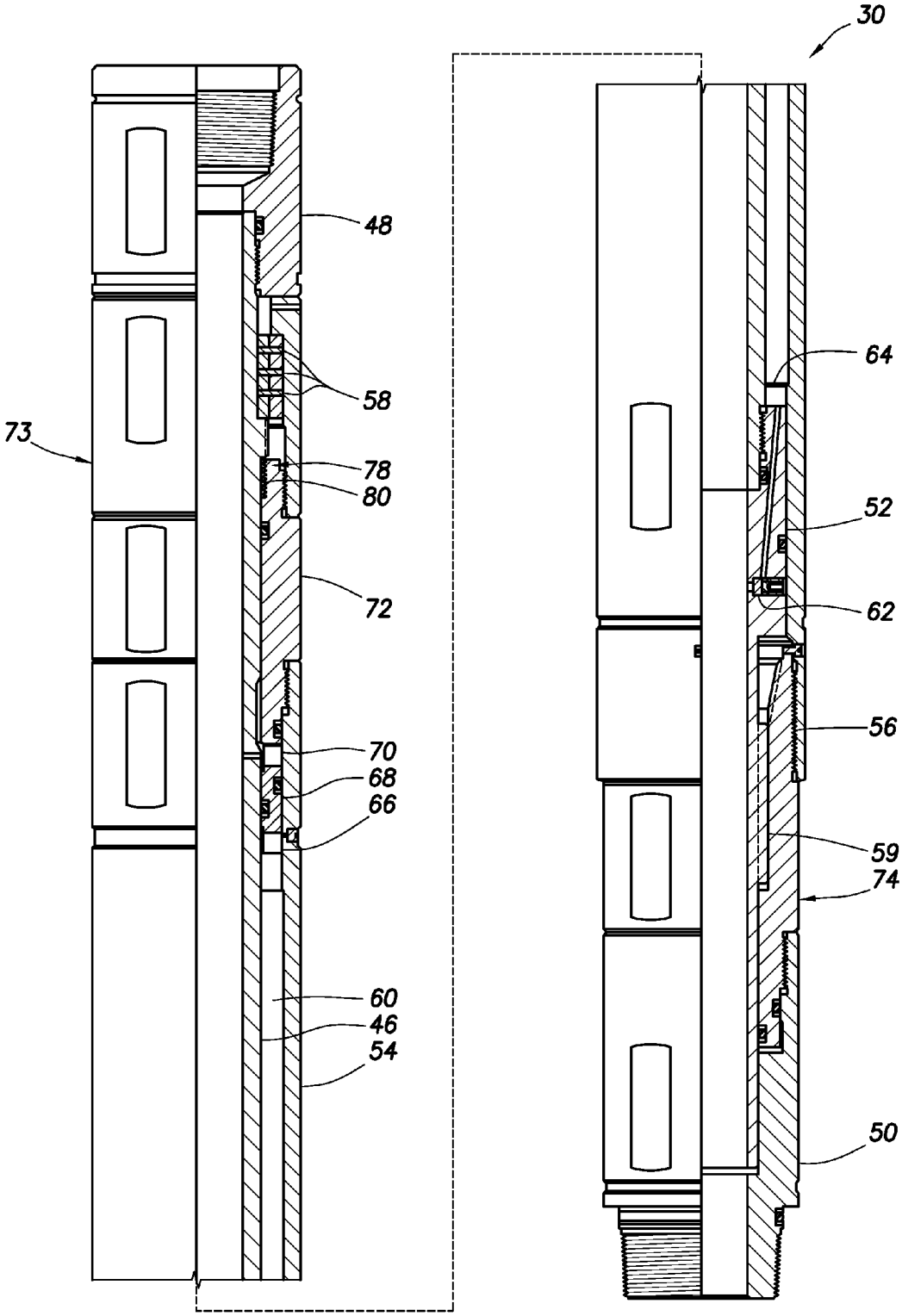
FIG. 3 is a cross-sectional view of a safety joint which can embody principles of this disclosure, and which may be used in the system and method of FIG. 1.

Referring additionally now to FIG. 3, the safety joint 30 is representatively illustrated, apart from the remainder of the system 10. The safety joint 30 may be similar in many respects to a prior art Below Packer Hydraulic Safety Joint marketed by Halliburton Energy Services, Inc., and well known to those skilled in the art.

The safety joint 30 is representative of an improved type of safety joint, operation of which can benefit from the principles of this disclosure. However, other types of safety joints may be used in the system 10, in keeping with the scope of this disclosure. Examples of other safety joints which may be improved using the principles of this disclosure include the Anchor Pipe Safety Joint, the RTTS™ Safety Joint and the VR™ Safety Joint, also marketed by Halliburton Energy Services, Inc.

The safety joint 30 includes a generally tubular mandrel 46 extending between end connectors 48, 50. When interconnected in the tubular string 12, the upper section 12*a* is connected to the connector 48, and the lower section 12*b* is connected to the connector 50.

As viewed in FIG. 3, the upper connector 48 has internal tapered threads for connecting to the upper tubular string section 12*a*, and the lower connector 50 has external tapered threads for connecting to the lower tubular string section 12*b*. However, any types of connections may be used, as desired.

A piston 52 is connected at a lower end of the mandrel 46. The piston 52 is sealingly and reciprocably received in an outer housing 54.

The lower connector 50 is connected to the outer housing 54 via left-hand threads 56. The mandrel 46 is connected to the upper connector 48.

Relative rotation between the mandrel 46 and the outer housing 54 is initially prevented by axially extending splines 59. Thus, right-hand torque can initially be transmitted from the upper connector 48 to the lower connector 50 via the mandrel 46 and splines 59.

Relative axial displacement between the mandrel 46 and the outer housing 54 is initially prevented by shear pins 58. However, if the lower connector 50 is secured against displacement in the wellbore 14 (e.g., if the lower tubular string section 12*b* has become stuck, etc.), and a predetermined upwardly directed axial force is applied to the upper connector 48, the shear pins 58 will shear, thereby permitting relative axial displacement between the mandrel 46 and the outer housing 54. The splines 59 do not prevent such relative axial displacement between the mandrel 46 and the outer housing 54.

A hydraulic fluid is contained in an annular chamber 60 formed radially between the mandrel 46 and the outer housing 54. When the mandrel 46 is permitted to displace axially upward relative to the outer housing 54 (e.g., upon shearing of the pins 58), the piston 52 will compress the fluid in the chamber 60. When pressure in the chamber 60 reaches a predetermined level, a rupture disk 62 will burst, allowing the fluid to drain from the chamber, and thereby permitting relatively unrestricted upward displacement of the mandrel 46 relative to the outer housing 54.

In this example, about a meter of upward displacement of the mandrel 46 is permitted relative to the outer housing 54. This upward displacement should be sufficient to accomplish unsetting of the packer 20, with the safety joint mandrel 46 being connected to the packer mandrel 34 and the remainder of the tubular string upper section 12*a*.

When displaced fully upward, castellated lugs 64 on an upper end of the piston 52 engage complementary lugs 66 on a floating piston 68, which also has lugs 70 which engage similar lugs (not visible in FIG. 3) on a component 72 connected to the outer housing 54. This engagement of lugs 64, 66, 70 (as well as those on the component 72) prevents relative rotation between the mandrel 46 and the outer housing 54. At this point, the splines 59 are disengaged.

Right-hand rotation can then be applied from the tubular string upper section 12*a* to the upper connector 48, mandrel 46 and outer housing 54 to "unscrew" the threads 56. The tubular string upper section 12*a*, along with an upper portion 73 of the safety joint 30 (comprising the upper connector 48, mandrel 46, outer housing 54, component 72, pistons 52, 68, etc.), can then be retrieved from the wellbore 14.

A lower portion 74 of the safety joint 30 (comprising the lower connector 50, threads 56, etc.) is left attached to the tubular string lower section 12*b*. The lower portion 74 is configured internally for convenient "fishing" of the tubular string lower section 12*b*.

It will be appreciated that if, after the rupture disk 62 has ruptured and the upper portion 73 is displaced upward relative to the lower portion 74, the tubular string 12*a* is then lowered, the packer 20 could be set. This would be unfortunate since, the safety joint 30 having already elongated, subsequent unsetting of the packer 20 may not be achieved by again raising the upper section 12*a* of the tubular string 12.

To prevent resetting of the packer 20, the safety joint 30 includes a locking device 78 which prevents downward displacement of the mandrel 46 relative to the component 72 (which, at this point, remains rigidly connected to the lower connector 50), after the safety joint has been elongated. In this manner, resetting of the packer 20 after elongation of the safety joint 30 can be prevented. In addition, jarring operations (for example, to free any stuck equipment below the safety joint) will be enabled, since a compressive force can be transmitted through the safety joint to the equipment below.

Figure 4:
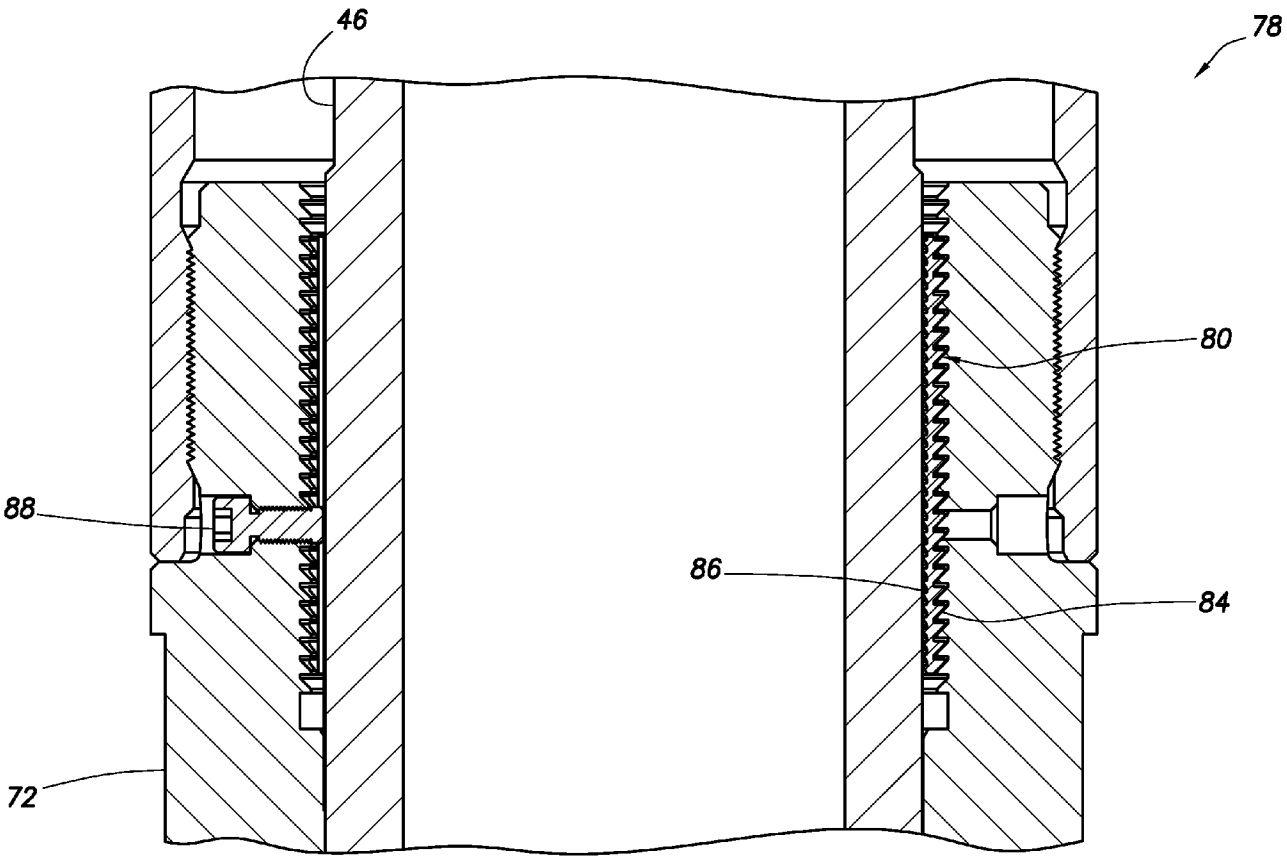
FIG. 4 is an enlarged scale representative cross-sectional view of a locking device of the safety joint.

In this example, the locking device 78 includes a resilient internally and externally toothed ring 80 which engages a complementarily toothed external surface 82 on the mandrel 46. An enlarged scale cross-sectional view of the locking device 78 is representatively illustrated in FIG. 4.

The ring 80 has relatively coarse buttress-type external threads 84 and relatively fine buttress-type internal threads 86. The ring 80 is longitudinally split on one side, so that it can radially expand or contract resiliently. A fastener 88 is installed in the longitudinal split to prevent rotation of the ring 80 relative to the component 72 in which it is received (e.g., so that the ring does not unthread from the component).

While the internal threads 86 are not engaged with the toothed external surface 82 of the mandrel 46, the locking device 78 does not prevent upward or downward displacement of the mandrel relative to the component 72. However, when the mandrel 46 has displaced upward a sufficient distance for the internal threads 86 to engage the toothed external surface 82, downward displacement of the mandrel relative to the component 72 will be prevented by such engagement, thereby preventing downward displacement of the upper portion 73 of the safety joint 30 (and the tubular string section 12*a* to which it is connected). This will prevent resetting of the packer 20.

Note that, when the internal threads 86 engage the toothed outer surface 82 on the mandrel 46, downward displacement of the mandrel relative to the component 72 will cause the ring 80 to be radially compressed (due to engagement of the external buttress-type threads 84 with complementarily shaped threads in the component 72 serving as ramps to bias the ring inward), causing the internal threads 86 to "bite" more forcefully into the external surface 82 of the mandrel. Thus, such downward displacement of the mandrel 46 relative to the component 72 is prevented after the internal threads 86 have engaged the toothed external surface 82.

In other examples, the threads 84, 86 could instead be circumferential ridges, grooves, recesses, or other shapes which can facilitate a gripping or other locking engagement between the mandrel 46 and the component 72. Similarly, the toothed external surface 82 on the mandrel 46 can be made up of any shapes or configurations which can operate satisfactorily in the locking device 78.

It is not necessary for the ring 80 to be used in the locking device 78, for the ring to be carried in the component 72, for the ring to be biased radially inward, for the external surface 82 to be toothed or otherwise specially configured (for example, the locking device could grip a smooth external surface) etc. Therefore, it should be clearly understood that the scope of this disclosure is not limited at all to the details of the locking device 78 depicted in the drawings and described herein.

Figure 5A:
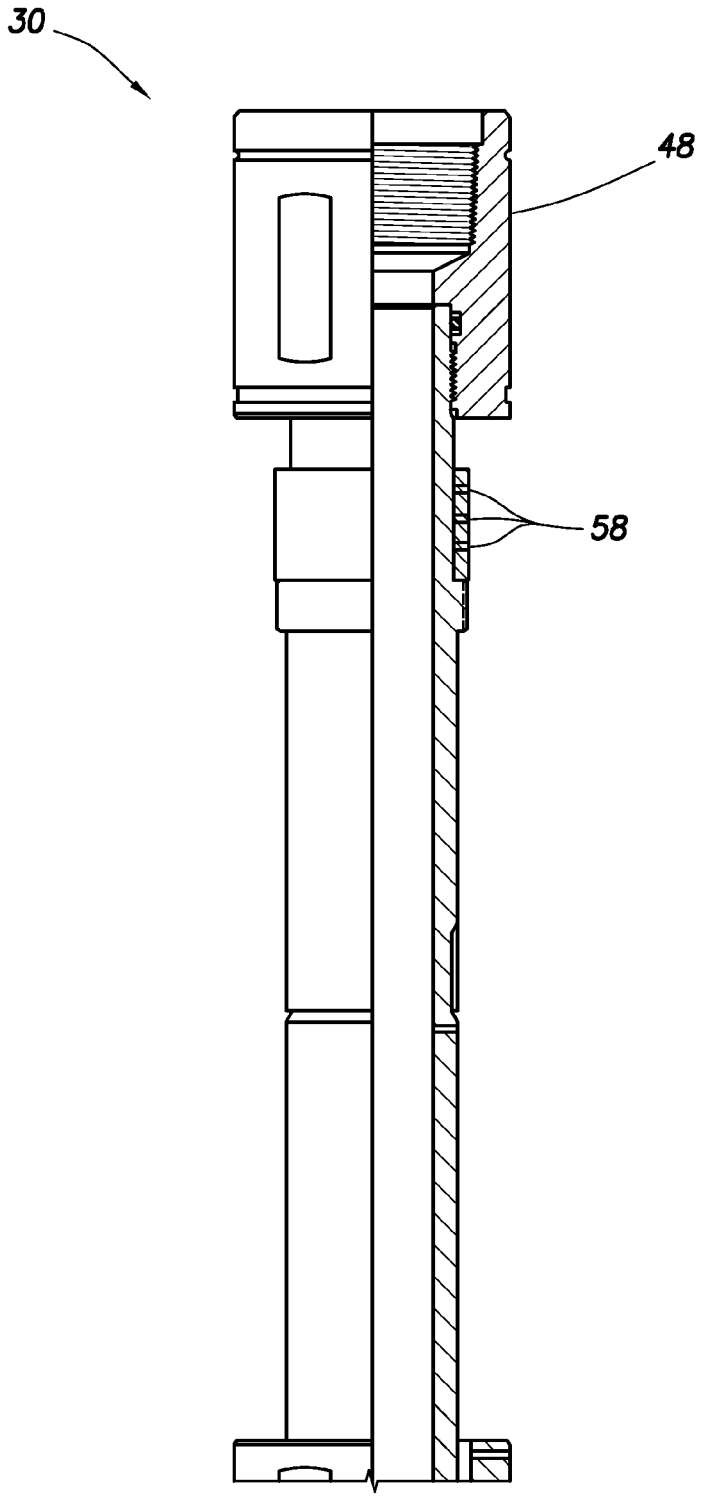
FIGS. 5A-C are representative cross-sectional views of the safety joint in an extended and locked configuration.
Figure 5B:
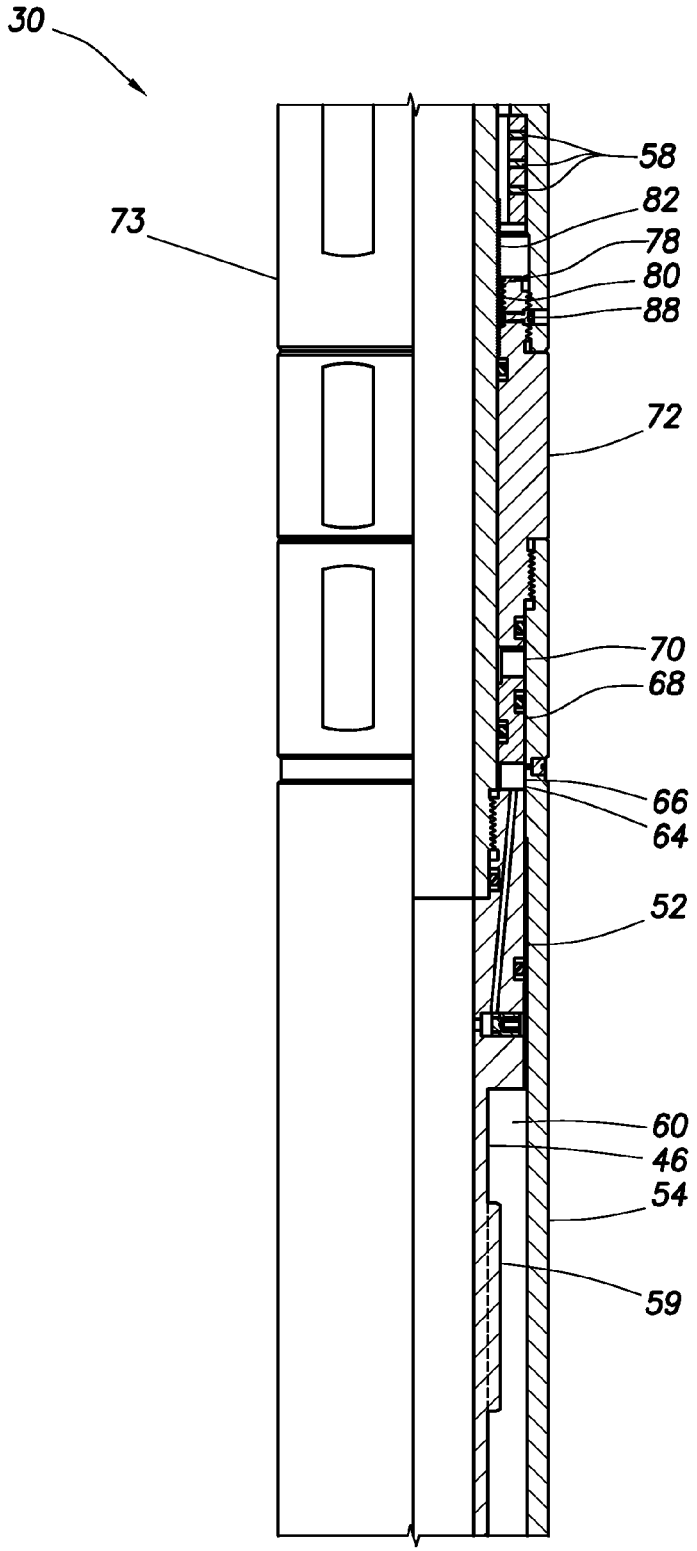
Figure 5C:
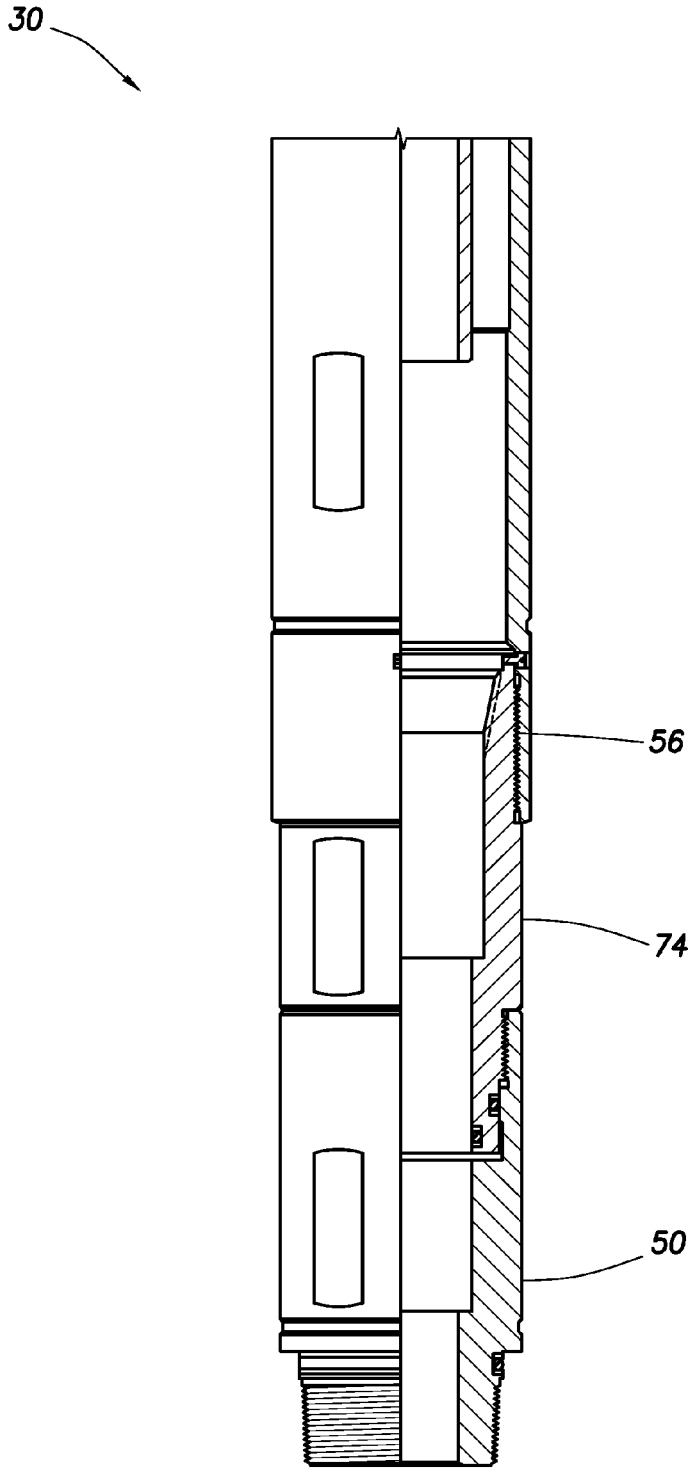

Referring additionally now to FIGS. 5A-C, the safety joint 30 is representatively illustrated after the shear pins 58 have been sheared, the rupture disk 62 has ruptured, and the safety joint has been elongated sufficiently far for the internal threads 86 of the locking device 78 to engage the toothed external surface 82 of the mandrel 46. In this configuration, the safety joint 30 is prevented from being longitudinally compressed, since the locking device 78 now prevents downward displacement of the mandrel 46. However, the mandrel 46 can still be displaced upward relative to the component 72 as needed (e.g., to permit right-hand rotation to unthread the threads 56 and disconnect the upper portion of the safety joint 30 from the lower portion 74).

Because the safety joint 30 cannot be longitudinally compressed, resetting of the packer 20 is prevented in the system 10. Furthermore, a jar (not shown) interconnected in the tubular string 12 can be used to transmit an impact through the safety joint 30, if desired, to free any stuck equipment below the safety joint.

Note that, although in the system 10, resetting of the packer 20 is prevented, it is not necessary in keeping with the scope of this disclosure for resetting of a packer to be prevented. For example, the safety joint 30 could be used in other systems and methods, and in circumstances in which its features are useful (e.g., in jarring operations, etc.), whether or not resetting of a packer is to be avoided.

It may now be fully appreciated that the above disclosure provides significant advancements to the arts of constructing and operating safety joints. Activation of the safety joint 30 in the depicted example prevents setting of the packer 20, so that the packer and tubular string upper section 12*a* can be retrieved without setting the packer.

The above disclosure provides to the art a safety joint 30 for use in a subterranean well. In one example, the safety joint 30 comprises separable portions 74, 76 which, when separated, disconnect sections 12*a*, *b* of a tubular string 12. Elongation of the safety joint 30 is permitted while longitudinal compression of the safety joint 30 is prevented.

The safety joint 30 can also include a locking device 78 which prevents the longitudinal compression of the safety joint 30. The locking device 78 may include a resilient toothed member. The resilient toothed member can comprise a longitudinally split ring 80.

The locking device 78 may grip an external surface 82 of a generally tubular mandrel 46. The external surface 82 can be gripped by an internally toothed member (e.g., the ring 80). The locking device 78 may prevent longitudinal compression of the safety joint 30 in response to a predetermined amount of the elongation of the safety joint 30.

A method of activating a safety joint 30 in a subterranean well is also described above. The method can, in some examples, comprise providing the safety joint 30 with portions 74, 76 having end connectors 48, 50 which interconnect the safety joint 30 between sections 12*a,b* of a tubular string 12; permitting elongation of the safety joint 30, thereby facilitating parting of the tubular string sections 12*a,b*; and then preventing longitudinal compression of the safety joint 30 prior to the tubular string 12 parting.

The permitting step can be performed after interconnecting the safety joint 30 between the sections 12*a,b* of the tubular string 12 and installing the tubular string 12 in the well.

The preventing step can be performed after a predetermined amount of the elongation of the safety joint 30 is achieved.

The preventing step may include a locking device 78 engaging, thereby preventing the end connectors 48, 50 from displacing toward each other.

The locking device 78 can comprise a resilient toothed member. The locking device 78 may engage an external surface 82 of a generally tubular mandrel 46 of the safety joint 30. The external surface 82 can comprise a toothed surface which is engaged by the locking device 78.

The preventing step can comprise preventing a packer mandrel 34 from displacing relative to a packer drag block 42. The preventing step may include preventing a packer 20 from setting.

A safety joint 30 for use in a subterranean well is described above. In one example, the safety joint 30 can comprise separable portions 74, 76 and a locking device 78 which permits relative displacement between a generally tubular mandrel 46 and a component 72 of the safety joint 30 in one direction, and prevents relative displacement between the mandrel 46 and the component 72 in an opposite direction.

The locking device 78 may prevent relative displacement between the mandrel 46 and the component 72 in the opposite direction in response to a predetermined amount of relative displacement between the mandrel and the component in the one direction.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A safety joint for use in a subterranean well, the safety joint comprising:

first and second separable portions which, when separated, disconnect sections of a tubular string, wherein elongation of the safety joint is permitted while longitudinal compression of the safety joint is prevented; and a locking device which prevents the longitudinal compression of the safety joint, wherein the locking device comprises a resilient toothed member.

2. The safety joint of claim 1, wherein the resilient toothed member comprises a longitudinally split ring.

3. A safety joint for use in a subterranean well, the safety joint comprising:

first and second separable portions which, when separated, disconnect sections of a tubular string, wherein elongation of the safety joint is permitted while longitudinal compression of the safety joint is prevented; and a locking device which prevents the longitudinal compression of the safety joint, wherein the locking device grips an external surface of a generally tubular mandrel.

4. The safety joint of claim 3, wherein the external surface is gripped by an internally toothed member.

5. A method of activating a safety joint in a subterranean well, the method comprising:

providing the safety joint with first and second portions having end connectors which interconnect the safety joint between sections of a tubular string;

permitting elongation of the safety joint, thereby facilitating parting of the tubular string sections; and then preventing longitudinal compression of the safety joint prior to the tubular string parting, wherein the preventing further comprises a locking device engaging, thereby preventing the end connectors from displacing toward each other.

6. The method of claim 5, wherein the locking device comprises a resilient toothed member.

7. The method of claim 5, wherein the locking device engages an external surface of a generally tubular mandrel of the safety joint.

8. The method of claim 7, wherein the external surface comprises a toothed surface which is engaged by the locking device.

9. The method of claim 5, wherein the preventing comprises preventing a packer mandrel from displacing relative to a packer drag block.

10. The method of claim 5, wherein the preventing comprises preventing a packer from setting.

11. A safety joint for use in a subterranean well, the safety joint comprising:

first and second separable portions; and a locking device which permits relative displacement between a generally tubular mandrel and a component of the safety joint in a first direction, and prevents relative displacement between the mandrel and the component in a second direction opposite to the first direction, wherein the locking device comprises a resilient toothed member.

12. A safety joint for use in a subterranean well, the safety joint comprising:

first and second separable portions; and a locking device which permits relative displacement between a generally tubular mandrel and a component of the safety joint in a first direction, and prevents relative displacement between the mandrel and the component in a second direction opposite to the first direction, wherein the locking device grips an external surface of a generally tubular mandrel.

* * * * *